US005347832A

United States Patent [19]

Copenhaver et al.

[11] Patent Number: 5,347,832

[45] Date of Patent: Sep. 20, 1994

[54] YARN BINDER APPARATUS

[76] Inventors: Richard Copenhaver, Rte. 5, Box 503, King, N.C. 27021; Larry Rainwater, 6074 Sweat Rd., Wallace, S.C. 29596; Luther Lane, Rte. 7, Box 778, Yadkinville, N.C. 27055; Roger Whittaker, Rte. 6, Box 142C, Mocksville, N.C. 27028; Kevin Boatwright, 210 Floyd St., Mullins, S.C. 29574; Joe Lee, 125 Hickory La., King, N.C. 27021

[21] Appl. No.: 157,855

[22] Filed: Nov. 24, 1993

[51] Int. Cl.[5] ..... D04B 15/60

[52] U.S. Cl. ..... 66/140 R; 66/134; 66/145 R

[58] Field of Search ..... 66/134, 140 R, 142 R, 66/145 R

[56] References Cited

U.S. PATENT DOCUMENTS

| | | | |
|---|---|---|---|
| Re. 30,557 | 3/1981 | Whittaker | 66/145 R |
| 2,527,069 | 10/1950 | Palmer | 66/134 |
| 3,115,761 | 12/1963 | Schmidt | 66/134 X |
| 3,154,932 | 11/1964 | King | 66/140 R X |
| 3,164,975 | 1/1965 | Haberhauer | 66/145 |
| 3,225,571 | 12/1965 | Mahler | 66/140 R X |
| 3,257,829 | 6/1966 | Parthum | 66/134 X |
| 3,520,154 | 7/1970 | Lawson | 66/140 R |
| 3,803,878 | 4/1974 | Lonati | 66/14 |
| 3,854,356 | 12/1974 | Okreglak | 83/66 |
| 4,099,392 | 7/1978 | Lonati | 66/140 R |
| 4,967,575 | 11/1990 | Fucik et al. | 66/14 |

*Primary Examiner*—Clifford D. Crowder
*Assistant Examiner*—John J. Calvert

[57] ABSTRACT

A binding mechanism for holding yarns of circular knitting machines during yarn changeover and when yarns are moved to inactive positions includes an elastomeric member having deformable when engaged with a flat surface and having pliable surfaces for simultaneously receiving and individually gripping multiple yarns, the member being of silicone rubber having a durometer hardness range of 45–70.

9 Claims, 1 Drawing Sheet

YARN BINDER APPARATUS

BACKGROUND, BRIEF SUMMARY AND OBJECTS OF THE INVENTION

This invention relates to yarn holding devices and more particularly to binding mechanisms for holding yarns of circular knitting machines during yarn change-over and when the yarns are moved to inactive positions.

In the knitting of fabric on circular knitting machines, it is common practice to employ a plurality of elastic and/or inelastic yarns which are selectively introduced to and removed from the knitting operation to achieve the desired knitted fabric. Feed fingers are provided at various yarn feed stations to introduce or remove yarns from the knitting positions, as required. When a given yarn is removed, it is severed in a conventional manner and the free end retained by a holding device so that the yarn will subsequently be available for reintroduction to the knitting machine needles.

Devices mounted upon circular knitting machines for holding the free ends of severed yarns are well known. For example, U.S. Pat. No. No. Re. 30557 discloses a metallic binder element having a bladelike edge which normally engages the machine dial. U.S. Pat. No. 3,164,975 discloses the use of leaf springs for clamping yarns to a dial cap. Such devices may be somewhat satisfactory when a single yarn is beneath the binder element.

The yarn binder of the present invention includes an element mounted for engagement with the machine dial which has a pliable surface resulting in good yarn grasping abilities. The binder element, of room temperature of vulcanized (RTV) silicone rubber, is attached to a support member which is adjustable to vary the pressure the member applies to the dial. Due to the flexibility of the gripping surfaces, plural yarns of various types and sizes may be satisfactorily retained at any one time.

One of the primary objects of the invention is the provision of a new and improved yarn binder having pliable gripping surfaces which operates independent of other knitting machine components.

Another object of the invention is the provision of a binding mechanism which ensures reliable, simultaneous gripping of a plurality of yarns of various sizes and types.

A further object of the invention is the provision of a binder mechanism having a rubber element selectively positioned relative to a knitting machine dial for gripping yarns therebetween and which overcomes disadvantages of prior art devices.

Still another object of the invention is the provision of a binder mechanism having an elongated elastomeric gripping element which is of simple, economical construction.

Other objects and advantages of the invention will become apparent when considered in view of the following detailed description.

DETAILED DESCRIPTION OF THE INVENTION

Figure 1:
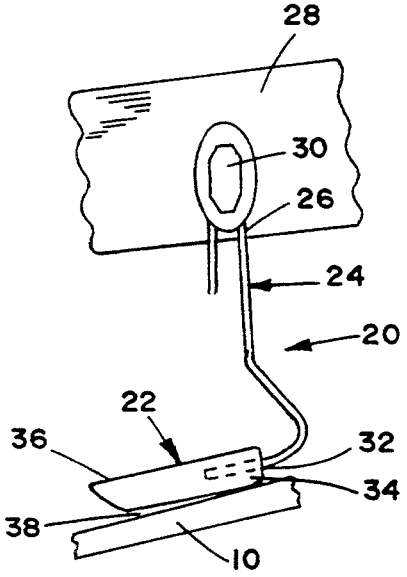
FIG. 1 is a fragmentary elevational view of one embodiment of the yarn binder mechanism supported upon a knitting machine with the elastomeric binder element in engagement with the machine dial.
Figure 2:
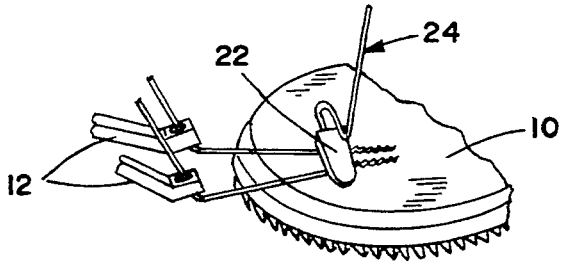
FIG. 2 is a fragmentary, perspective view of a knitting machine dial plate, yarn feed fingers, and the yarn binder mechanism of FIG. 1.
Figure 3:
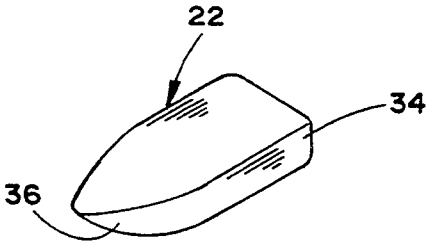
FIG. 3 is an enlarged, perspective view of the elastomeric binder element of the binder mechanism of FIGS. 1 and 2.

Referring to the drawing, and initially to FIGS. 1–3, reference numeral 10 designates a dial cap or plate of a conventional circular knitting machine. Conventional yarn feed fingers 12, of the knitting machine are shown by FIG. 2. While two feed fingers have been shown, the number may vary depending on the type of fabric being knitted.

The yarn binder mechanism 20 of the embodiment of FIGS. 1–3, includes an elongated elastomeric member 22 formed of room temperature vulcanized silicone rubber, and a support member 24 thereof. The support member 24 consists of a wire member having an upper portion 26, attached to the knitting machine dial 20 by a fastener 30, and a lower portion 32 bent generally at a right angle with respect to the portion 26 and extending into the heel portion 34 of the elastomeric binder member 22. The forward end portion 36 of the elastomeric member 22 is pointed, as shown by FIGS. 1 and 3, and also tapered to provide a gap 38 under the end portion 36 and above the dial plate 10, thus facilitating the displacement and wedging of yarn between the elastomeric member 22 and the plate 10 to retain the yarn in position when disengaged from the knitting instrumentalities. The binder wire 24 may be bent slightly to position the elastomeric member 22 to the correct setting relative to the direction of yarn movement and to apply a selected amount of pressure on the dial plate 10. The binder member forward end pointed portion 36 should be positioned just off the dial 10 with the gap 38 diminishing or closing towards the heel portion 34. The elastomeric binder may be swiveled on the wire portion 32 to level it laterally with respect to the dial plate 10.

The wire member 24 may be of various sizes and types, and in a preferred embodiment has a diameter of approximately 0.020 inches. The durometer hardness of the elastomeric element 22 may be within the range of 45–70, and in a preferred embodiment has a durometer hardness of 60. The room temperature vulcanized silicone rubber will not break down or harden when it comes in contact with oil and with heat generated by the knitting machine.

At any one time, two or more yarns of various sizes or deniers may be clamped between the elastomeric member and dial plate at an one time. The pliable surface of the member 22 permits the various sizes to be equally grasped.

Figure 4:
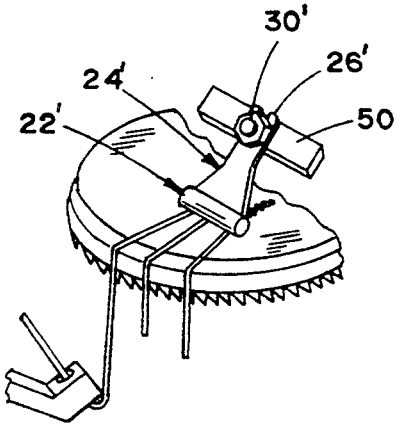
FIG. 4 is a fragmentary, perspective view of a knitting machine illustrating a modified embodiment of the yarn binder mechanism of the invention.
Figure 5:
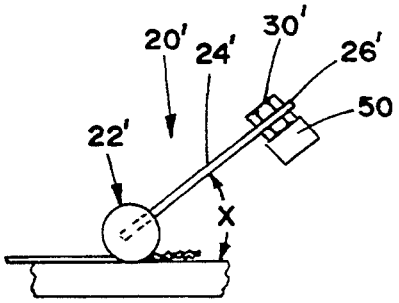
FIG. 5 is an enlarged, fragmentary, side elevational view of the modified yarn binder mechanism on a knitting machine.
Figure 6:
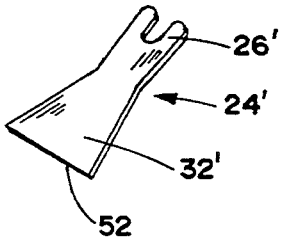
FIG. 6 is a perspective view of the support for the elastomeric binder element.

FIGS. 4–6 illustrate another embodiment of the yarn binder mechanism of the invention. The mechanism 20' includes an elastic binder member 22' formed of the same material and having the same durometer hardness as the member 22 which is attached to a support member 24'.

The support member 24' preferably is of spring steel construction having an upper portion 26' attached by a fastener 30' to a member 50 of a circular knitting machine, and a lower portion 32' for coupling to the binder member 22.

The spring support member 24' extends downwardly from the fastener 30' at a relatively steep angle X, FIG. 5, and terminates in a flat, straight, blade-like edge 52. The edge 52 is downstream of the upper fixed end 26' in the direction of yarn travel.

In the embodiment of FIGS. 4–6, the binder member 22' has a generally cylindrical configuration which is slit longitudinally to approximately the center of the member. The edge 52 of the spring support member 24 is then inserted in the slit and the elastic forces of the binder 22' grip the opposite sides of the lower portion 32' of the member 24'. Preferably, the cylindrical binder member 22' is approximately one inch in length to accommodate and grasp several yarns, which may be of various sizes, between the binder 22' and the dial plate 10.

We claim:

1. Apparatus in a knitting machine for simultaneously holding yarns adjacent severed end portions comprising; supporting means including a dial plate having a relatively flat surface, a yarn binder mechanism including an elongated support member and an elongated elastomeric member attached thereto, fastener means for adjustably mounting one end of said elongated support member upon said supporting means, said elongated support member having a free end portion for supporting said elongated elastomeric member thereon, said elastomeric member including an elongated linear portion engageable with said relatively flat surface under slight pressure, said elongated linear portion having pliable surface means deformable for receiving simultaneously multiple yarns and for individually gripping and clamping each of such yarns positioned intermediate said elastomeric member and said relatively flat surface, said elastomeric member being of silicone rubber having a durometer hardness range of 45–70.

2. Apparatus as recited in claim 1, wherein said elongated elastomeric member is mounted on said elongated support member by inserting said free end portion into said elongated elastomeric member.

3. Apparatus as recited in claim 1, said elongated support member being formed of resilient metal for flexibly adjusting to pressure applied by said elongated linear portion to said relatively flat surface.

4. Apparatus as recited in claim 3, wherein said elastomeric member elongated linear portion includes curved surfaces for facilitating positioning of yarns therebelow.

5. Apparatus as recited in claim 4, wherein said elastomeric member is of a cylindrical configuration having a slit extending longitudinally of said elastomeric member for receiving therein the free end portion of said elongated support member.

6. Apparatus as recited in claim 4, wherein said elastomeric member includes a heel portion for receiving therein said elongated support member and for engaging said relatively flat surface and a pointed forward end portion tapered to provide a gap between said forward end portion and said relatively flat surface.

7. Apparatus as recited in claim 6, wherein said elongated support member is formed of piano wire permitting said elastomeric member to swivel relative thereto to level said elastomeric member relative to relatively flat surface.

8. Apparatus in a knitting machine for simultaneously, individually holding a plurality of yarns adjacent severed end portions comprising; support means including a dial plate and a support member, a yarn binder means mounted upon said support member, said binder means including an elastomeric element in engagement with said dial plate and an elongated flexible member having one end secured to said support member and free second end supporting said elastomeric element, said elastomeric element being of room temperature vulcanized rubber having a durometer hardness range of 45–70 and having an elongated linear portion for individually clamping and retaining yarns of variable sizes against said dial plate.

9. Apparatus as recited in claim 8, wherein said elastomeric element has a durometer hardness of 60.

* * * * *